US009819108B2

(12) United States Patent
Miny et al.

(10) Patent No.: US 9,819,108 B2
(45) Date of Patent: Nov. 14, 2017

(54) ELECTRICAL CONNECTOR FOR A FUEL INJECTOR HAVING A TERMINAL WITH A TWISTED INTERMEDIATE SECTION

(71) Applicant: DELPHI INTERNATIONAL OPERATIONS LUXEMBOURG S.À R.L., Bascharage (LU)

(72) Inventors: Eric Miny, Chailles (FR); Fabrizio A. Bonfigli, Mont pres Chambord (FR)

(73) Assignee: DELPHI INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 0 days.

(21) Appl. No.: 14/914,093

(22) PCT Filed: Jul. 30, 2014

(86) PCT No.: PCT/EP2014/066393
§ 371 (c)(1),
(2) Date: Feb. 24, 2016

(87) PCT Pub. No.: WO2015/028236
PCT Pub. Date: Mar. 5, 2015

(65) Prior Publication Data

US 2016/0211601 A1 Jul. 21, 2016

(30) Foreign Application Priority Data

Aug. 26, 2013 (FR) ..... 13 58176

(51) Int. Cl.
*H01R 13/40* (2006.01)
*H01R 13/11* (2006.01)
(Continued)

(52) U.S. Cl.
CPC ..... *H01R 13/112* (2013.01); *F02M 51/005* (2013.01); *H01R 13/04* (2013.01);
(Continued)

(58) Field of Classification Search
CPC ..... H01R 9/00; H01R 9/053; H01R 9/0757; H01R 13/04; H01R 13/112; H01R 13/113; H01R 13/40; H01R 13/41; H01R 13/46
(Continued)

(56) References Cited

U.S. PATENT DOCUMENTS 6,336,829 B2 * 1/2002 Matsukawa ..... H01R 12/57 439/636
6,821,150 B2 * 11/2004 Hall ..... H01R 9/0515 439/108
(Continued)

FOREIGN PATENT DOCUMENTS

DE 19823509 C1 11/1999
DE 10117061 A1 10/2002
(Continued)

OTHER PUBLICATIONS

International Search Report, PCT/EP2014/066393, dated Sep. 25, 2014.

*Primary Examiner* — Chandrika Prasad
(74) *Attorney, Agent, or Firm* — Joshua M. Haines

(57) ABSTRACT

A flat electrical terminal is produced from a metal plate having a terminal thickness and of which one end is delimited by a first edge at the center of which a slot opens, extending along a main axis and allowing the complementary insertion and electrical connection of another flat terminal electrically connected to a device. The two opposing sides of the slot are provided with protuberances, each extending towards the opposite side such that the other terminal is designed to be in contact with the tops of the protuberances.

7 Claims, 3 Drawing Sheets

(51) Int. Cl.

| | |
|---|---|
| ***H01R 13/41*** | (2006.01) |
| ***F02M 51/00*** | (2006.01) |
| ***H01R 13/04*** | (2006.01) |
| ***H01R 13/46*** | (2006.01) |
| *F02M 47/02* | (2006.01) |

(52) U.S. Cl.
CPC ..... *H01R 13/113* (2013.01); *H01R 13/41* (2013.01); *H01R 13/46* (2013.01); *F02M 47/027* (2013.01)

(58) Field of Classification Search
USPC ..... 439/733, 734, 735
See application file for complete search history.

(56) References Cited

U.S. PATENT DOCUMENTS

| | | | | |
|---|---|---|---|---|
| 7,040,915 | B1 * | 5/2006 | Pollack | H01R 4/184 439/424 |
| 7,160,155 | B2 * | 1/2007 | Sanftleben | F02M 51/005 439/680 |
| 7,381,097 | B2 * | 6/2008 | Ellis | H01R 13/6464 439/676 |
| 7,677,934 | B2 * | 3/2010 | Piovesan | H01R 13/112 439/818 |
| 7,988,500 | B2 * | 8/2011 | Furukawa | H01R 13/41 439/66 |
| 8,840,408 | B2 * | 9/2014 | Baba | H01R 12/58 439/83 |
| 2006/0040537 | A1 | 2/2006 | Sanftleben et al. | |
| 2010/0136852 | A1 * | 6/2010 | Mito | H01R 13/41 439/733.1 |

FOREIGN PATENT DOCUMENTS

| | | | |
|---|---|---|---|
| DE | 102008045810 | A1 | 3/2010 |
| EP | 0007870 | A1 | 2/1980 |
| EP | 1575136 | A2 | 9/2005 |

* cited by examiner

ELECTRICAL CONNECTOR FOR A FUEL INJECTOR HAVING A TERMINAL WITH A TWISTED INTERMEDIATE SECTION

CROSS REFERENCE TO RELATED APPLICATIONS

This application is a national stage application under 35 USC 371 of PCT Application No. PCT/EP2014/066393 having an international filing date of Jul. 30, 2014, which is designated in the United States and which claimed the benefit of FR Patent Application No. 1358176 filed on Aug. 26, 2013, the entire disclosures each are hereby incorporated by reference in their entirety.

TECHNICAL FIELD

The present invention relates to the electrical connector of a fuel injector and more particularly to terminals.

TECHNICAL BACKGROUND OF THE INVENTION

Fuel injectors are provided with actuators controlled as electromagnets generally arranged at mid-height of the injector. The electrical connection of the coil thus passes through the upper part of the body of the injector and exits therefrom so as to form the outer connector. This adds electrical connections, however, and in an effort to permanently optimize the overall size and performance, it is beneficial to propose a device having few connections and that is small in size.

SUMMARY OF THE INVENTION

The object of the present invention is to overcome these problems by proposing a flat electrical terminal produced from a metal plate having a terminal thickness and of which one end is delimited by a first edge at the center of which a slot opens, extending along a main axis. The slot allows the complementary insertion and electrical connection of another flat terminal electrically connected to a device. The two opposing sides of the slot are provided with protuberances, each extending toward the opposite side such that said other terminal is designed to be in contact with the tops of the protuberances.

In addition, the protuberances on one side are arranged offset in relation to those on the opposite side such that a protuberance is arranged opposite a trough between two protuberances.

In addition, one of the sides of the slot has at least two protuberances, whereas the opposite side has at least one protuberance.

The median line of the slot is a wavy line, the slot being of constant width around said wavy line, the waves forming the protuberances and troughs. The lines joining the tops of the protuberances on the sides are two parallel straight lines separated from one another by a distance smaller than the thickness of the terminal.

The first edge of the terminal delimits an inner portion of the terminal which is formed substantially in a first plane. The terminal also has a distant outer portion intended to receive an electrical connector in a complementary arrangement so as to assure the electrical power supply of said device. The outer portion is formed substantially in a second plane.

In particular, the first plane and the second plane are perpendicular, the plate having been twisted in an intermediate portion.

The invention also relates to an electrical connector comprising a plastics casing in which at least one terminal formed in accordance with the above paragraphs is overmolded or inserted, the terminal emerging on both sides of the casing.

The invention also relates to a fuel injector comprising an actuator electrically connected to a connector formed in accordance with the above paragraph.

BRIEF DESCRIPTION OF THE DRAWINGS

Further features, objectives and advantages of the invention will become clearer upon reading the detailed description provided hereinafter and with reference to the accompanying figures, which are given by way of non-limiting example.

DESCRIPTION OF PREFERRED EMBODIMENTS

Figure 1:
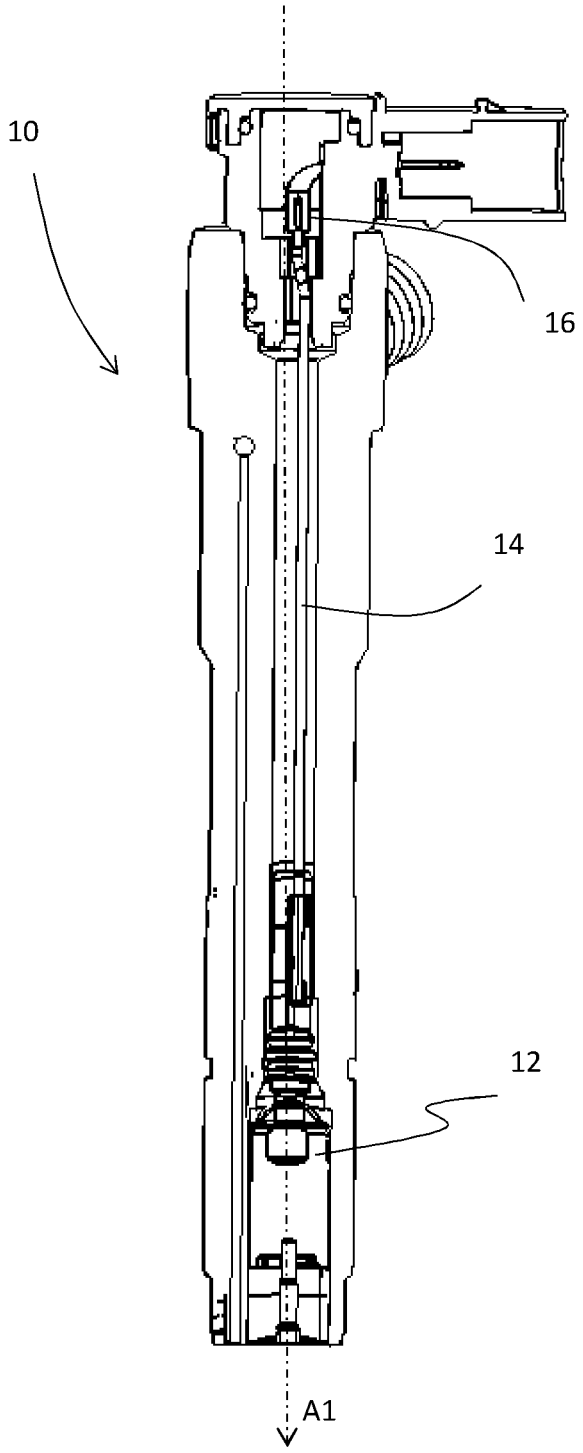
FIG. 1 is an axial section of a fuel injector.

In accordance with FIG. 1 a fuel injector 10 extends in the general direction of a main axis A1. The injector 10 is provided with an actuator 12, for example an electromagnet. At the bottom, in the conventional sense of FIG. 1 without this choice limiting the invention, the injector 10 is usually provided with a needle that is hydraulically controlled in order to seal or to open injection holes via which the fuel is sprayed into a combustion chamber. The actuator 12 is electrically connected to an inner conductor 14 extending along the direction of the main axis A1 to the top of the injector 10, still in the conventional sense of FIG. 1. At its tip, the inner conductor 14 is provided with a flat connection terminal 16. The connection terminal 16 is made of metal, rectangular in shape, and has a thickness E16. It is in contact with an outer terminal 18, which is part of the electrical connector 20 of the injector 10.

Figure 2:
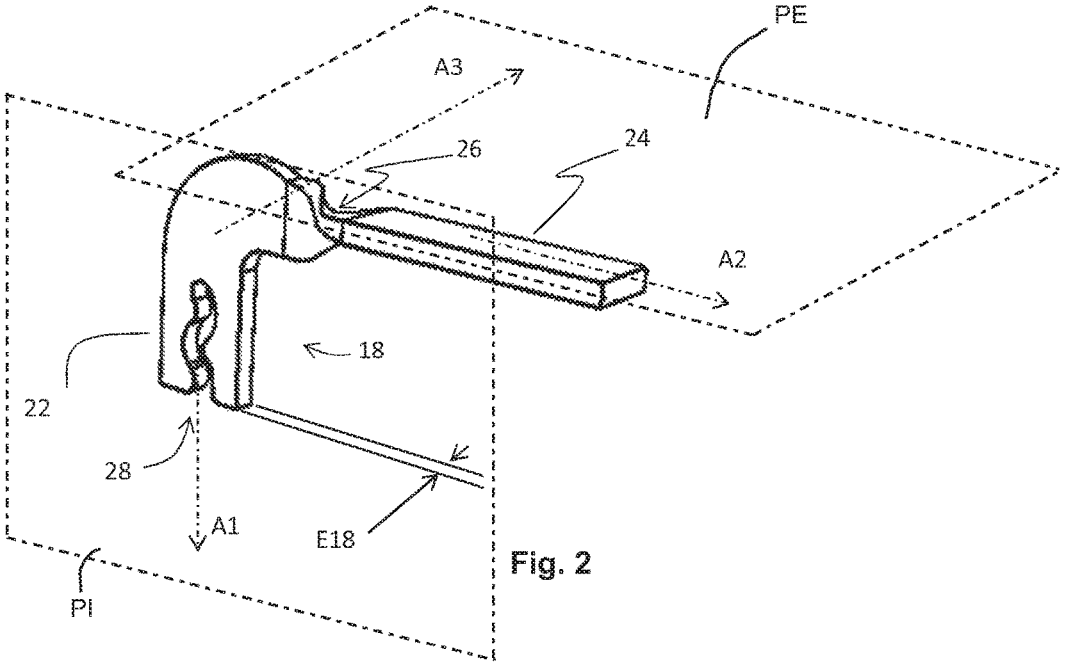
FIG. 2 is an isometric view of an electrical terminal equipping the injector of FIG. 1.

The outer terminal 18 will now be described with reference to FIGS. 2 and 3. The outer terminal 18 is produced from a metal plate of thickness E18 and is shaped so as to have an inner portion 22 designed to be in electrical connection with the connection terminal 16, and an outer portion 24, designed to be in electrical connection with a complementary electrical plug so as to thus transmit the electric current to the actuator 12. Between the inner 22 and outer 24 portions, the outer terminal 18 has an intermediate portion 26, where deformations of the outer terminal 18 are concentrated. Thus, the inner 22 and outer 24 portions are both flat and have the same thickness E18, but are formed in two separate planes: an inner plane PI and outer plane PE respectively. In a coordinate system having three orthogonal axes shown in FIG. 2 and comprising the main axis A1, a second axis A2, and a third axis A3, the inner plane PI is normal to the third axis A3, whereas the outer plane PE is normal to the main axis A1. As can be seen in the example of FIG. 2, the metal plate used to produce the outer terminal 18 is L-shaped, each of the limbs corresponding to an inner 22 or outer 24 portion. The plate was then twisted through 90° along the second axis A2 such that the outer portion 24 is now perpendicular to the plane PI of the inner portion 22. As can be seen in FIG. 2, the intermediate portion 26 is a zone of slightly weakened section such that the deformation is concentrated here. It goes without saying that the shape given to the outer terminal 18 and described above is only an illustrative example and that any other shape can be produced.

Figure 3:
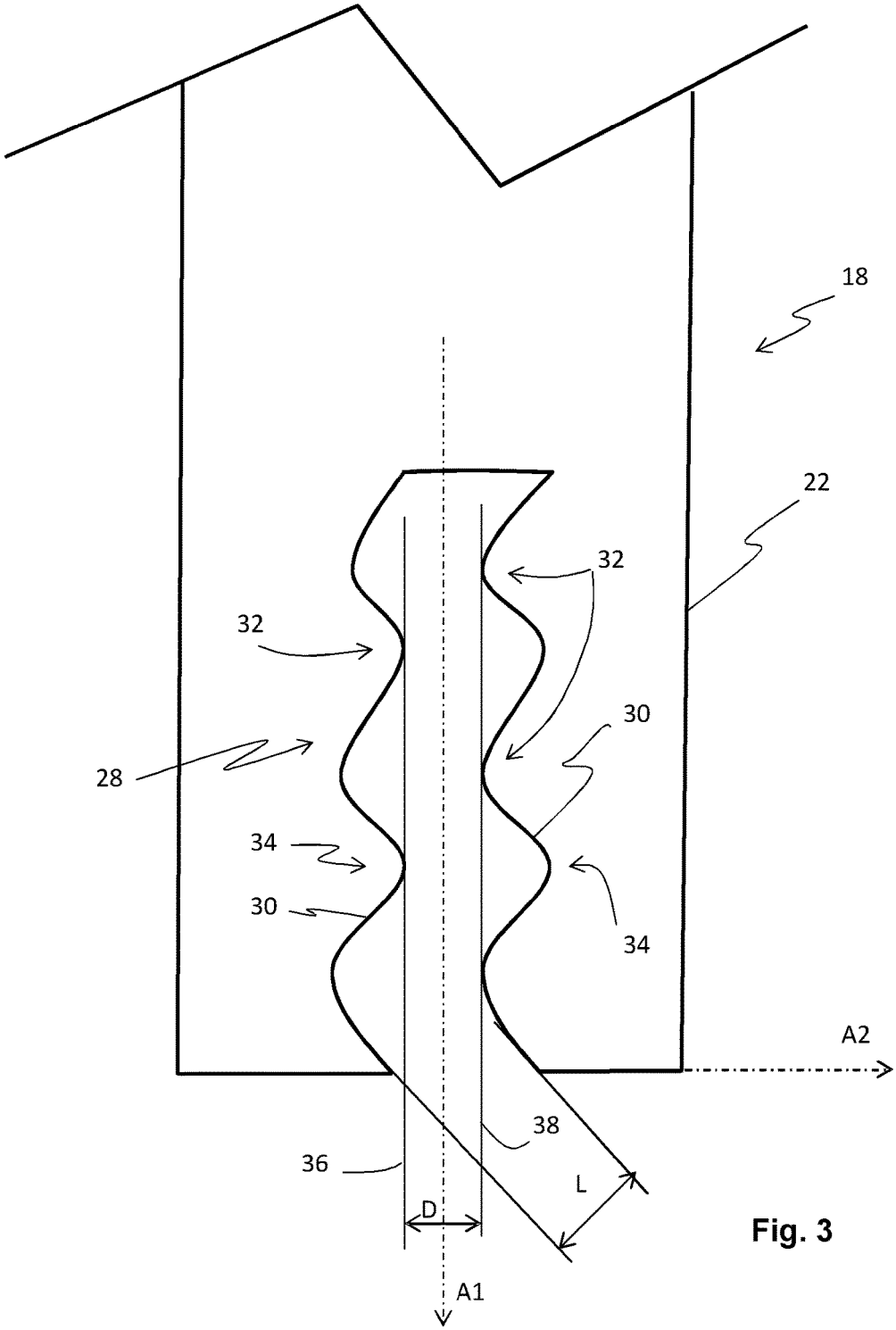
FIG. 3 is a detail of the terminal of FIG. 2.

The complementary insertion of the connection terminal 16 and of the outer terminal 18 is performed at the inner portion 22, which, as can be seen in FIG. 2 and as is particularly detailed in FIG. 3, is provided with a slot 28 extending substantially along the main axis A1 from approximately the middle of the inner portion 22 to the center of the lower edge of the inner portion 22. The lower edge extends at the bottom of the outer terminal 18 along the second axis A2.

In accordance with a first shown embodiment, the slot 28 follows a wavy line and has a constant width L. The slot 28 thus formed has two sides 30, which are wavy and parallel. The convex parts form protuberances 32, which are alternated with concave parts forming troughs 34. Thus, the protuberances 32 on one side 30 are opposite troughs 34 on the other side 30. In addition, the undulations are regular and a first virtual straight line 36 extending along the main axis A1 passes via the tops of the protuberances 32 on one side 30, and a second virtual straight line 38, which is parallel to the first straight line 36, passes via the tops of the protuberances 32 on the other side 30. The two straight lines 36, 38 are separated by a distance D measured along the second axis A2.

The connection terminal 16 may thus be inserted into the slot 28 by being placed in contact with only the tops of the protuberances 32; since the thickness E16 of the connection terminal 16 is just greater than the distance D separating the straight lines 36, 38, a slight resilient gap of the slot 28 enables the complementary insertion of the connection terminal 16.

In accordance with an alternative (not shown) to this embodiment, the slot 28 can be formed in a straight line, but provided with alternated protuberances.

It is now well understood that these protuberances make it possible to retain the connection terminal 16. At the least, one side 30 of the slot 28 will have just one protuberance 32 and will be arranged opposite the other side 30, which will have two protuberances 32. The connection terminal 16, once inserted into the slot 28, will be in contact at three points, corresponding to the three tops. A greater number of protuberances is of course possible.

The selected example of a terminal for a fuel injector also is not limiting to the possible use of the terminal.

In terms of dimensions, the distance D between the straight lines 36 is smaller than the width L and also smaller than the thickness E18 of the outer terminal 18.

Figure 4:
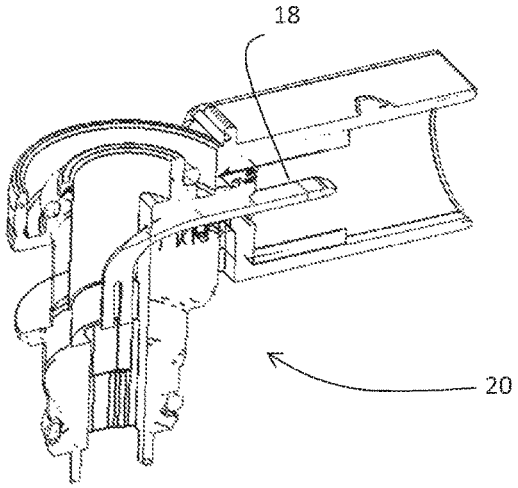
FIG. 4 is an exploded view of the electrical connector of the fuel injector of FIG. 1.

In accordance with FIG. 4 the connector 20 is shown. It has two outer terminals 18 for supplying power to the actuator 12. The connector 20 is formed from molded plastic, and the inner 22 and outer 24 portions extend on either side of the connector 20.

The invention claimed is:

1. A flat electrical terminal produced from a metal plate having a terminal thickness, said electrical terminal comprising:

an inner portion with said terminal thickness formed in a first plane;

an outer portion with said terminal thickness formed in a second plane which is perpendicular to said first plane, said outer portion forming an L-shape with said inner portion, said outer portion being configured to receive an electrical connector;

an intermediate section between said inner portion and said outer portion such that said intermediate section is twisted through 90°;

a first edge which delimits said electrical terminal and said inner portion; and a slot which opens at a center of said first edge, said slot extending along a main axis, said slot allowing complementary insertion and electrical connection of another flat terminal electrically connected to a device, and said slot having two opposing sides which are provided with protuberances which each extend toward the opposite said opposing side such that said other terminal contacts said protuberances.

2. The electrical terminal as claimed in claim 1, wherein said protuberances on one of said opposing sides are arranged offset in relation to said protuberances on the other one of said opposing sides such that one of said protuberances on one of said opposing sides is arranged opposite a trough between said protuberances of the other one of said opposing sides.

3. The electrical terminal as claimed in claim 2, wherein one of said opposing sides of said slot has at least two said protuberances and the other of said opposing sides has at least one said protuberance.

4. The electrical terminal as claimed in claim 1, wherein said opposing sides are each a wavy line such that said slot has a constant width, said wavy line of each of said opposing sides forming said protuberances and troughs between said protuberances.

5. The electrical terminal as claimed in claim 1, wherein a first line connecting tops of said protuberances on one of said opposing sides is parallel to a second line connecting tops of said protuberances on the other of said opposing sides such that said first line and said second line are separated by a distance that is less than said thickness of said electrical terminal.

6. An electrical connector comprising a plastics casing in which said electrical terminal of claim 1 is located and emerges on both sides of said casing.

7. A fuel injector comprising an actuator electrically connected to a connector as claimed in claim 6.

* * * * *